US012084951B2

(12) United States Patent
Zhelonkin et al.

(10) Patent No.: US 12,084,951 B2
(45) Date of Patent: Sep. 10, 2024

(54) METHOD FOR INTERVAL ACTION ON HORIZONTAL WELLS

(71) Applicant: TOTA SYSTEMS LIMITED LIABILITY COMPANY (TOTA SYSTEMS LLC), Moscow (RU)

(72) Inventors: Alexandr Leonidovich Zhelonkin, Almetievsk (RU); Ilshat Damirovich Vakhitov, Almetievsk (RU); Vitaly Petrovich Filippov, Bugulma (RU); Gabdrashit Sultanovich Abdrakhmanov, Moscow (RU)

(73) Assignee: TOTA SYSTEMS LIMITED LIABILITY COMPANY (TOTA SYSTEMS LLC), Moscow (RU)

( * ) Notice: Subject to any disclaimer, the term of this patent is extended or adjusted under 35 U.S.C. 154(b) by 192 days.

(21) Appl. No.: 17/634,636

(22) PCT Filed: Jul. 17, 2020

(86) PCT No.: PCT/RU2020/050160
§ 371 (c)(1),
(2) Date: Feb. 11, 2022

(87) PCT Pub. No.: WO2021/029786
PCT Pub. Date: Feb. 18, 2021

(65) Prior Publication Data

US 2022/0325605 A1 Oct. 13, 2022

Related U.S. Application Data

(60) Provisional application No. 62/886,367, filed on Aug. 14, 2019.

(51) Int. Cl.
*E21B 27/00* (2006.01)
*E21B 33/124* (2006.01)
(Continued)

(52) U.S. Cl.
CPC ..... *E21B 43/14* (2013.01); *E21B 27/005* (2013.01); *E21B 33/124* (2013.01);
(Continued)

(58) Field of Classification Search
CPC ..... E21B 34/066; E21B 43/121; E21B 43/14; E21B 43/25
See application file for complete search history.

(56) References Cited

U.S. PATENT DOCUMENTS 7,108,067 B2 * 9/2006 Themig ..... E21B 34/142 166/334.4
9,181,774 B2 * 11/2015 Khisamov ..... E21B 43/128
(Continued)

FOREIGN PATENT DOCUMENTS

CN 107780902 A * 3/2018
CN 105422058 B * 6/2018
(Continued)

OTHER PUBLICATIONS

International Search Report for PCT/RU2020/050160 dated Nov. 19, 2020, 2 pages.
(Continued)

*Primary Examiner* — Jennifer H Gay
(74) *Attorney, Agent, or Firm* — Nixon & Vanderhye PC

(57) ABSTRACT

A horizontal segment of the well is bored preliminarily, the segment being constructed through a formation with various permeability zones. A geophysical survey is conducted, and the number of oil recovery intervals of various categories and their lengths are determined. A tail pipe (or tail filter) of the casing string with packers and drive shoe are lowered down and installed in the horizontal segment. A pump and an assembly on the pipe string are lowered down into the well, the assembly including electric valves with pressure and temperature sensors, cabling, and packers separating the
(Continued)

annular space of the well. The assembly packers are arranged opposite to the casing string packers. While lowering down the assembly, some electric valves are opened, and another electric valve (for circulation) is closed. Data from the sensors are monitored. The formation segments are periodically treated by injecting a chemical composition into the corresponding intervals.

17 Claims, 3 Drawing Sheets

(51) Int. Cl.

| | |
|---|---|
| ***E21B 34/06*** | (2006.01) |
| ***E21B 43/12*** | (2006.01) |
| ***E21B 43/14*** | (2006.01) |
| ***E21B 47/06*** | (2012.01) |

(52) U.S. Cl.
CPC ..... *E21B 34/066* (2013.01); *E21B 43/126* (2013.01); *E21B 47/06* (2013.01); *E21B 2200/04* (2020.05)

(56) References Cited

U.S. PATENT DOCUMENTS

| | | | | |
|---|---|---|---|---|
| 9,745,833 | B2 * | 8/2017 | Carvajal | E21B 43/00 |
| 2004/0118564 | A1 * | 6/2004 | Themig | E21B 43/25 166/305.1 |
| 2006/0131029 | A1 | 6/2006 | Zupanick | |
| 2013/0186618 | A1 * | 7/2013 | Khisamov | E21B 33/13 166/50 |
| 2014/0124195 | A1 * | 5/2014 | Tahoun | E21B 34/12 166/250.01 |
| 2016/0273315 | A1 * | 9/2016 | Carvajal | E21B 43/12 |
| 2019/0040715 | A1 * | 2/2019 | Provost | E21B 33/124 |
| 2022/0325605 | A1 * | 10/2022 | Zhelonkin | G06Q 50/02 |

FOREIGN PATENT DOCUMENTS

| | | | |
|---|---|---|---|
| RU | 2 042 807 | | 8/1995 |
| RU | 71 755 | | 3/2008 |
| RU | 71755 | U1 * | 3/2008 |
| RU | 2 433 307 | | 11/2011 |
| RU | 2433307 | C1 * | 11/2011 |
| RU | 2 488 686 | | 7/2013 |
| RU | 2 534 555 | | 11/2014 |
| RU | 2534555 | C1 * | 11/2014 |
| RU | 2 547 190 | | 4/2015 |
| RU | 2547190 | C1 * | 4/2015 |
| RU | 2653216 | C1 * | 5/2018 |

OTHER PUBLICATIONS

Written Opinion of the ISA for PCT/RU2020/050160 dated Nov. 19, 2020, 6 pages.

* cited by examiner

*Method of interval action on the horizontal wells operated by the downhole pumping equipment and the device for its implementation*

*Method of interval action on the horizontal wells operated by the downhole pumping equipment and the device for its implementation*

METHOD FOR INTERVAL ACTION ON HORIZONTAL WELLS

This application is the U.S. national phase of International Application No. PCT/RU2020/050160 filed Jul. 17, 2020 which designated the U.S. and claims priority to U.S. Provisional Application No. 62/886,367 filed Aug. 14, 2019, the entire contents of each of which are hereby incorporated by reference.

FIELD OF THE INVENTION

The present invention relates to the oil-and-gas industry, specifically, to the development and exploitation of oil reservoirs with various permeability zones, including by means of lateral and horizontal bores from production strings.

BACKGROUND OF THE INVENTION

The prior art discloses a method of the bottomhole formation zone treatment (RF Patent No. 2042807, E21B 43/27, publ. date 27 Aug. 1995) by sequential injection of an oil-based spacer fluid into formation, and an inhibited aqueous solution of hydrochloric acid or mud acid characterized in that after the injection of the inhibited aqueous solution of hydrochloric acid or mud acid in a mixture with an alcohol-containing product at the ratio from 1:1 to 1:2 into the formation, the second spacer fluid is injected being stable natural gasoline constituting a mixture of saturated hydrocarbons C3+higher, wherein the stable natural gasoline and isopropyl alcohol at a ratio of (1-3):1, respectively, are used as the oil-based spacer fluid. In order to implement the method, a tubing string is used that is lowered in the well down to the perforation interval and the measured depth.

The disadvantage of this method is the impossibility of performing the targeted acid treatment for certain borehole intervals, as well as high costs due to the large amount of tripping operations related to the well treatment and development.

The closest prior art to the claimed invention is the method of separation and control of the recovery of reserves drained by horizontal well and the device for its implementation (RF Patent No. 2488686, E21B 43/12, 43/14, publ. date 27 Jul. 2013, Bulletin No. 21).

The device for the method implementation comprises a pipe string with a cable, controlling devices in the form of electric valves, pressure and temperature sensing devices and one or several packers overspanning the downhole, wherein the sensing devices are connected to the measurement unit arranged at the well mouth and the controlling devices are connected to the control unit through a cable, wherein a pump for the production fluid recovery through the tube side is arranged above the controlling devices. Besides, the well is fitted with horizontal segment extending through the formation with various permeability zones, and the packers are arranged in the horizontal segment of the well separating the various permeability zones of the formation, the tube side is separated by a blank plug over which the upper and the lower controlling devices are installed one above another, the said controlling devices being arranged within the vertical well bore and equipped with sensing devices, wherein the inlet of the lower controlling device is in communication with the tube side below the blank plug and its outlet is in communication with the tube side above the blank plug, the inlet of the upper controlling device is in communication with the downhole and its outlet is in communication with the tube side above the blank plug, that communicates with the inlet of the pump, wherein the well spaces with identical or similar permeability split off by the packers are bundled into two groups each of which communicates with a tube side or a downhole through one or several elbows, wherein the sensing devices and the controlling devices are connected through one cable with the measurement unit and the control unit, respectively, wherein each of the controlling devices is made in the form of an electric motor with a gear box arranged in a case, wherein the electric motor' and gear box rotatory shaft is connected with a pusher and a valve through a bolt-nut connection, the said valve being configured to tightly interact with a seat, below which a sleeve with an inlet in the form of channels is arranged, the sleeve housing a compensating chamber with elastic walls filled with a lubricating fluid and communicating with the pusher interior space and with a sealed space arranged above the pusher.

This device is characterized by the following disadvantages: impossibility of an active agent (e.g., acid or mud) injection into the well through the valve since the valve ball cannot be fixed in the open state; high probability of the production string damaging when high pressure is created during the active agent injection into the well; the number of the independent production intervals is limited with two zones combining intervals with the same permeability.

SUMMARY OF THE INVENTION

The technical problem to be solved by the claimed group of inventions is the expansion of the technological capabilities during the device operation inside the well with a horizontal segment, with the possibility of independent inclusion or exclusion of each of the production intervals and of the active agent injection into the well through the valve thanks to the separation of various permeability intervals and the use of pilot-operated electric valves, as well as the improvement of the electric valves reliability by excluding the sliding actuators (sensitive to pressure jumps) from the valve driving mechanism and providing for the possibility of the assembly operations that exclude the cable twisting and damaging, thanks to a special adapter use.

The technical result of the claimed group of inventions is the enabling of the independent inclusion or exclusion of each of the production intervals and of the active agent injection into the well through the valve thanks to the separation of various permeability intervals and the use of pilot-operated electric valves, as well as the improvement of the electric valves reliability by excluding the sliding actuators (sensitive to pressure jumps) from the valve driving mechanism and providing for the possibility of the assembly operations that exclude the cable twisting and damaging, thanks to a special adapter use.

The claimed technical result is achieved thanks to the fact that the method of interval action on horizontal wells includes the following steps: a horizontal segment (8) of the well (9) is bored preliminarily, being constructed through the formation (12) with various permeability zones; geophysical survey is conducted and the number of the oil recovery intervals of various categories and their lengths are determined;

a tail pipe or a tail filter (13) of the casing string (14) with the packers (15), (7) and the drive shoe (39) arranged on the string in accordance with the sizes of the said oil recovery intervals is lowered down into the horizontal segment (8) and installed there;

an assembly on the pipe string (1) is lowered down into the horizontal segment (8) and installed inside the tail pipe (13), the same assembly consisting of the electric valves (3), (4), (18) with the pressure and temperature sensing devices (5), (6), (41), the cable (2) and the packers (16), wherein the packers (16) are arranged so that they are located opposite the corresponding packers (7) and (15), hermetically separating the annular space (17); a centrifugal pump (10) in the casing (19) rigidly connected with the pipe string (1) is arranged inside the production string (14); while lowering the assembly down into the well (9), the electric valves (3), (4) are opened for filling the tube side (11) of the pipe string (1) with the production fluid of the well (9), but the circulation electric valve (18) is closed; the data obtained from the sensing devices are monitored; the formation (12) segments are periodically treated by injecting a chemical composition into the corresponding interval of the well (9) horizontal segment (8).

In a particular embodiment of the claimed technical solution, while lowering down the equipment, the tube side (11) of the pipe string (1) is filled with the production fluid of the well (9), and the electric valves (3), (4), (18) and (38) are opened when the well (9) is operated with the sucker-rod pump (32)

In a particular embodiment of the claimed technical solution, the electric valve (38) is closed before the production fluid of the well (9) is extracted with the help of the sucker-rod pump (32).

In a particular embodiment of the claimed technical solution, to monitor the data obtained from the sensing devices, the electric valves (3) and (4) are closed or opened.

In a particular embodiment of the claimed technical solution, to inject a chemical composition for the formation (12) treatment into the corresponding interval of the well (9) horizontal segment (8), the following steps are performed: the electric valves (3) and (4) are closed and the circulation electric valve (18) is opened, then the production fluid is pushed out to the surface from the tube side (11) through the annular space (43) of the string (14) by injecting the calculated volume of the chemical composition into the tube side (11) of the string (1) up to the circulation valve (18); using circulation electric valve (18), the communication with the annular space (43) is shut off and the corresponding electric valve (3) or (4) is opened for performing the treatment of the necessary formation (12) interval; the required volume of the chemical composition is forced into the formation (12), the electric valve (3) or (4) is closed for the technological exposure period; after the technological exposure the corresponding electric valve (3) or (4) is opened, the pump is started and the calculated volume of the production fluid located in the tube side (11) is pumped out from the electric valve to the casing (19); the corresponding electric valve (3) or (4) is closed, the valve (18) is opened and the reaction products are washed out from the tube side (11) to the surface; this operation is repeated until the production fluid of the formation (12) appears at the surface; then the extraction of the production fluid of the well (9) is continued in normal mode.

In a particular embodiment of the claimed technical solution, to provide for the interval treatment of the formation (12), for the wells operated with the help of the sucker-rod pump (32), the production fluid is pushed out to the surface through the annular space (43) by injecting the calculated volume of the chemical composition into the tube side (11) of the pipe string (1) through the lateral channels (37) of the adapter (33) and the opened electric valve (38), wherein the circulation electric valve (18) is opened beforehand, and the electric valves (3) and (4) are closed.

In a particular embodiment of the claimed technical solution, after the production fluid is pushed out of the tube side (11), the communication with the annular space (43) is shut off by the circulation electric valve (18), and the necessary electric valve (3) or (4) is opened for performing the treatment of the corresponding formation (12) interval: the necessary volume of the chemical composition is forced into the formation (12), the electric valve (3) or (4) is closed for the technological exposure period; after the technological exposure the electric valve (38) is closed, the electric valve (3) or (4) and the circulation valve (18) are opened, the sucker-rod pump (32) is started and the production fluid located in the annular space (43) is pumped out up to the casing (19) of the pump (32); then the pump is stopped, the electric valve (3) or (4) is closed and the electric valve (38) is opened; the reaction products are evacuated to the surface by injecting the production fluid into the tube side (11) of the pipe string (1) through the circulation valve (18) and through the annular space (43); the operation is repeated until the production fluid of the formation (12) appears at the surface; then the extraction of the production fluid of the formation (12) is continued from the well (9) in normal mode.

The technical result is also achieved thanks to the fact that the device for the interval action on horizontal wells operated by the downhole pumping equipment includes the following: a pipe string (1) with the cable (2), two or more electric valves (3) and (4) equipped with sensing devices, at least one packer separating the inner space of the horizontal segment (8) of the well (9) into two or more intervals and a centrifugal pump (10) arranged at a calculated distance from the well mouth; wherein the said electric valves (3), (4) and the sensing devices (5), (6) are connected through the cable (2) with the interface unit at the well mouth characterized in that the pipe string (1) above the electric valves (3) and (4) is equipped with the circulation electric valve (18) intended for connecting the tube side (11) of the pipe string (1) with the annular space (43) of the well (9) during the pipe string (1) flushing.

In a particular embodiment of the claimed technical solution, one or more of the said sensing devices is a pressure sensor.

In a particular embodiment of the claimed technical solution, one or more of the said sensing devices is a temperature sensor.

In a particular embodiment of the claimed technical solution, it additionally comprises a tail pipe or a tail filter (13) hermetically connected with the casing string (14), and the device is additionally equipped with packers (16) separating the annular space (17) into the corresponding permeable sections.

In a particular embodiment of the claimed technical solution, the pump is additionally enclosed in a protective casing (19).

In a particular embodiment of the claimed technical solution, each electric valve (3), (4) and (18) is made in the form of an electric motor (21) with a gear box (22) arranged in a case (20), wherein the electric motor rotates the shaft (23) connected through the spindle (24) with the valve (25) configured to tightly interact with the seats (27), wherein the inlet (28) and outlet (29) openings are arranged above the seats (27).

In a particular embodiment of the claimed technical solution, the valve (25) is made in the form of a ball (30) with a cylindrical through-hole (31) made across the case (20), wherein in the «open» position the opening (31) of the ball (30) connects the inlet opening (28) with the outlet opening (29) allowing the production fluid to get into the tube side (11) of the pipe string (1), and in the «closed» position it shuts off its entry into the tube side (11) of the pipe string (1).

In a particular embodiment of the claimed technical solution, the external casing (19) comprises the adapter (33) having radial channels (34) connecting the well (9) annulus with the central axial channel (35) and the sucker-rod pump (32), wherein the central channel (35) is closed with the blank plug (36) from below.

In a particular embodiment of the claimed technical solution, lateral channels (37) are made in the adapter (33) coaxially with the central channel (35).

In a particular embodiment of the claimed technical solution, the pipe string (1) is additionally equipped with the electric valve (38) for closing the tube side (11) of the pipe string (1) below the casing (19) when extracting the production fluid, and for its opening when injecting the active agent into the horizontal segment (8) of the well (9) during the bottomhole formation zone treatment.

In a particular embodiment of the claimed technical solution, the pump, the electric cables, the valves and the packers are made corrosion resistant.

In a particular embodiment of the claimed technical solution, the packers (15) and (7) are arranged so that they would isolate the recovery intervals with various permeability between themselves along the length of the horizontal segment (8), and the tail pipe (13) has perforation openings (40) or is equipped with a well strainer in each of the intervals.

In a particular embodiment of the claimed technical solution, the cable (2) in the horizontal well bore is arranged inside the tubing joint.

Thus, the use of the invention allows expanding technological capabilities when extracting production fluids from the wells with horizontal segments cased with the tail pipes through placing the pipe string with the electric valves in the tail pipe, wherein the electric valves, thanks to the packers, are hermetically arranged opposite to the various permeability intervals, with the possibility of shutting off the watered out intervals without stopping the oil extraction; wherein additional independent channels are used for the interval treatment of the formations with working agents, the same channels excluding the action of the chemicals and of the high pressure on the production string walls and allowing changing the downhole pumping equipment without withdrawing the device to the surface; and, additionally, thanks to using the electric valves with the swinging type shutting-off device, their reliability is improved.

Figure 1:
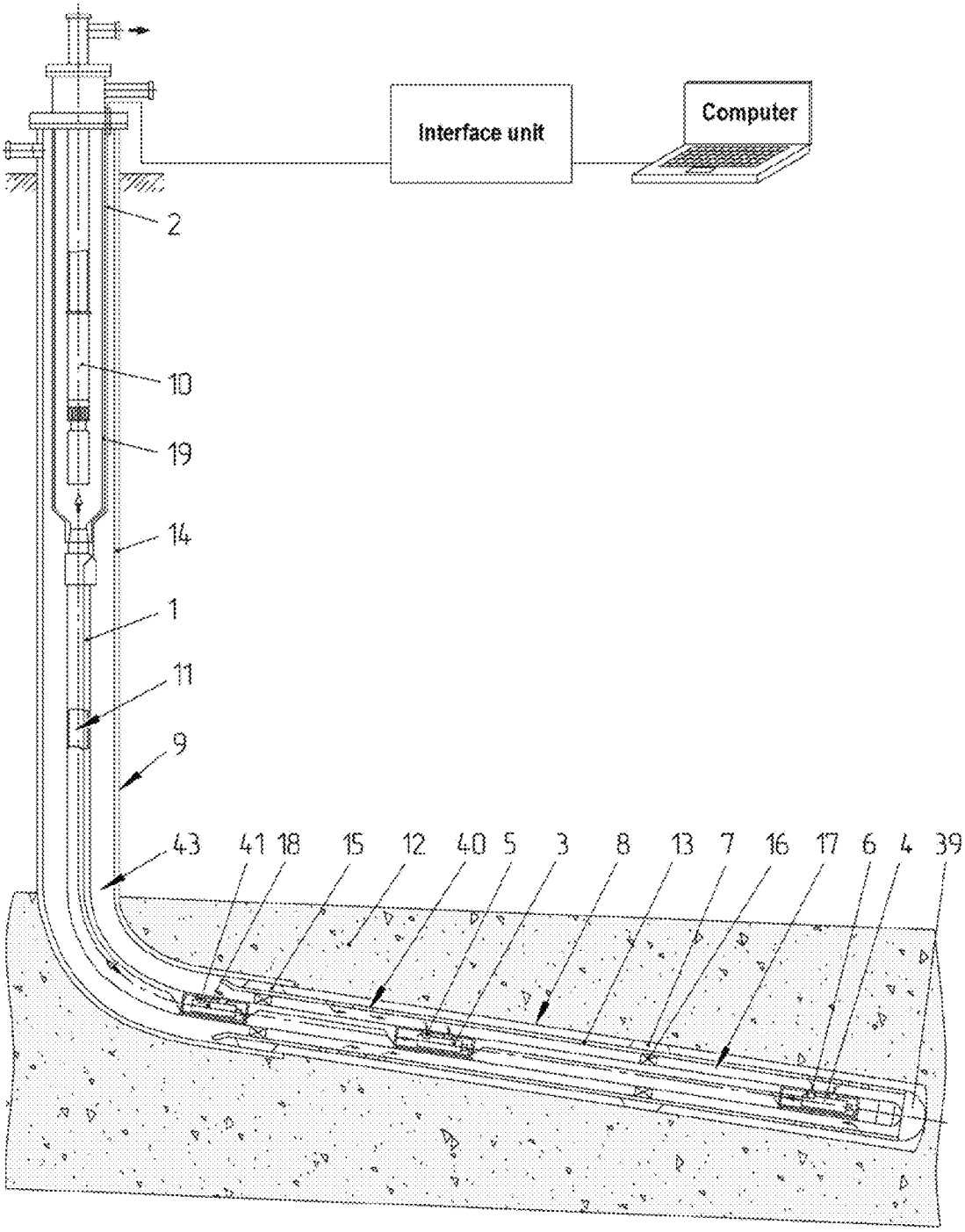
FIG. 1 shows the device with centrifugal pump—general view.

Numbers in the drawings indicate the following items:

1—pipe string; 2—cable; 3—electric valve; 4—electric valve; 5—sensing device; 6—sensing device; 7—packer; 8—inner space of the horizontal segment of the well; 9—well; 10—electric submersible pump; 11—tube side; 12—formation; 13—tail pipe or tail filter; 14—casing string; 15—packer; 16—additional packer; 17—annular space; 18—circulation electric valve; 19—external casing; 20—case; 21—electric motor; 22—gear box; 23—rotation shaft; 24—spindle; 25—valve; 26—sealing ring; 27—seat; 28—inlet opening; 29—output opening; 30—ball; 31—cylindrical through-hole; 32—sucker-rod pump; 33—adapter; 34—radial channels; 35—central axial channel; 36—blank plug; 37—lateral channels; 38—electric valve; 39—drive shoe; 40—perforation openings; 41—sensing device; 42—longitudinal channel; 43—annular space.

DISCLOSURE OF THE INVENTION

Device for the interval action on horizontal wells operated by the downhole pumping equipment (FIG. 1); comprises a pipe string (1) with a cable (2), two or more electric valves (3 and 4) with the pressure (and temperature) sensing devices (5, 6), a packer (or packers) (7) separating the inner space of the horizontal segment (8) of the well (9) into two or more intervals.

The electric valves (3, 4) and sensing devices (5, 6) are connected through the cable (2) with the interface unit at the well mouth. An electric submersible pump (10) is arranged at a calculated distance from the well mouth, for the production fluid recovery through the tube side (11).

The horizontal segment (8) of the well (9) is constructed through the formation (12) with various impermeability zones, separating the formation (12) with the help of packers (7) into the intervals (low permeability and medium- or high permeability) based on the geophysical survey results.

If a tail pipe or a tail filter (13) of the casing string (14) is used, that is lowered down to the measured depth and is hermetically (e.g., with the help of the packer (15)) connected with the casing string (14), packers (16) are additionally installed that separate the annular space (17) into the corresponding permeable sections.

The novelty consists in the fact that the pipe string (1) is equipped with the circulation electric valve (18) located above the electric valves (3) and (4), which is intended for connecting the tube side (11) of the pipe string (1) with the space of the well (9) during the pipe string (1) flushing, e.g., of the remnants of the chemical composition that has been injected into the horizontal segment (8) during the bottomhole formation zone treatment.

The centrifugal pump (10) is enclosed in the casing (19) to exclude the action of the chemicals and of the high pressure on the production string walls (14) during the chemical composition injection into the horizontal segment (8) of the well (9).

Figure 4:
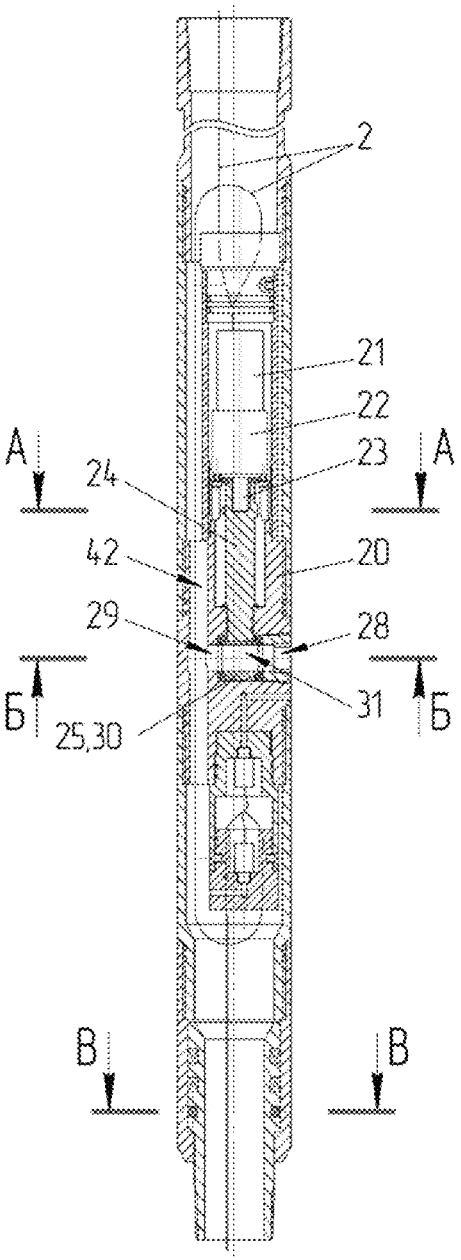
FIG. 4 shows an electric valve—general view.
Figure 5:
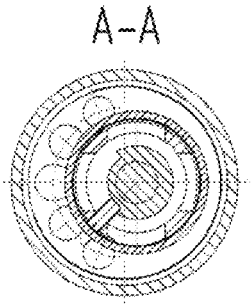
FIG. 5 shows cross-section A-A of FIG. 4 (magnified)
Figure 6:
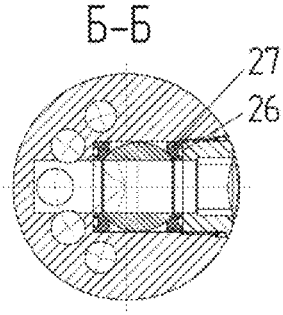
FIG. 6 shows cross-section 6-6 of FIG. 4 (magnified)
Figure 7:
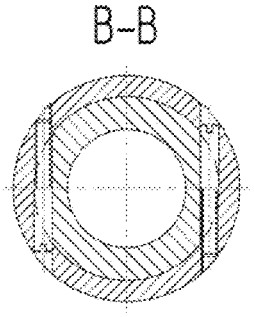
FIG. 7 shows cross-section B-B of FIG. 4 (magnified).

That said, each electric valve (3), (4) and (18) is made in the form of an electric motor (21) with a gear box (22) arranged in the case (20) (FIG. 4), the rotatory shaft (23) of the said electric motor and gear box being connected through the spindle (24) with the valve (25) configured to tightly interact (e.g., thanks to the sealing rings (26) (FIG. 6)) with the seats (27). The inlet (28) (FIG. 4) and outlet (29) openings are arranged above the seats (27).

The novelty consists in the fact that the valve (25) is made in the form of a ball (30) with a cylindrical through-hole (31) made across the case (20). Wherein in the «open» position the opening (31) of the ball (30) connects the inlet opening (28) with the outlet opening (29) allowing the production fluid to get into the tube side (11) (FIG. 1) of the pipe string (1), and in the «closed» position (when the ball (30) (FIG. 4) is turned 90 degrees) it shuts off its entry into the tube side (11) (FIG. 1) of the pipe string (1).

Figures 2, 3:
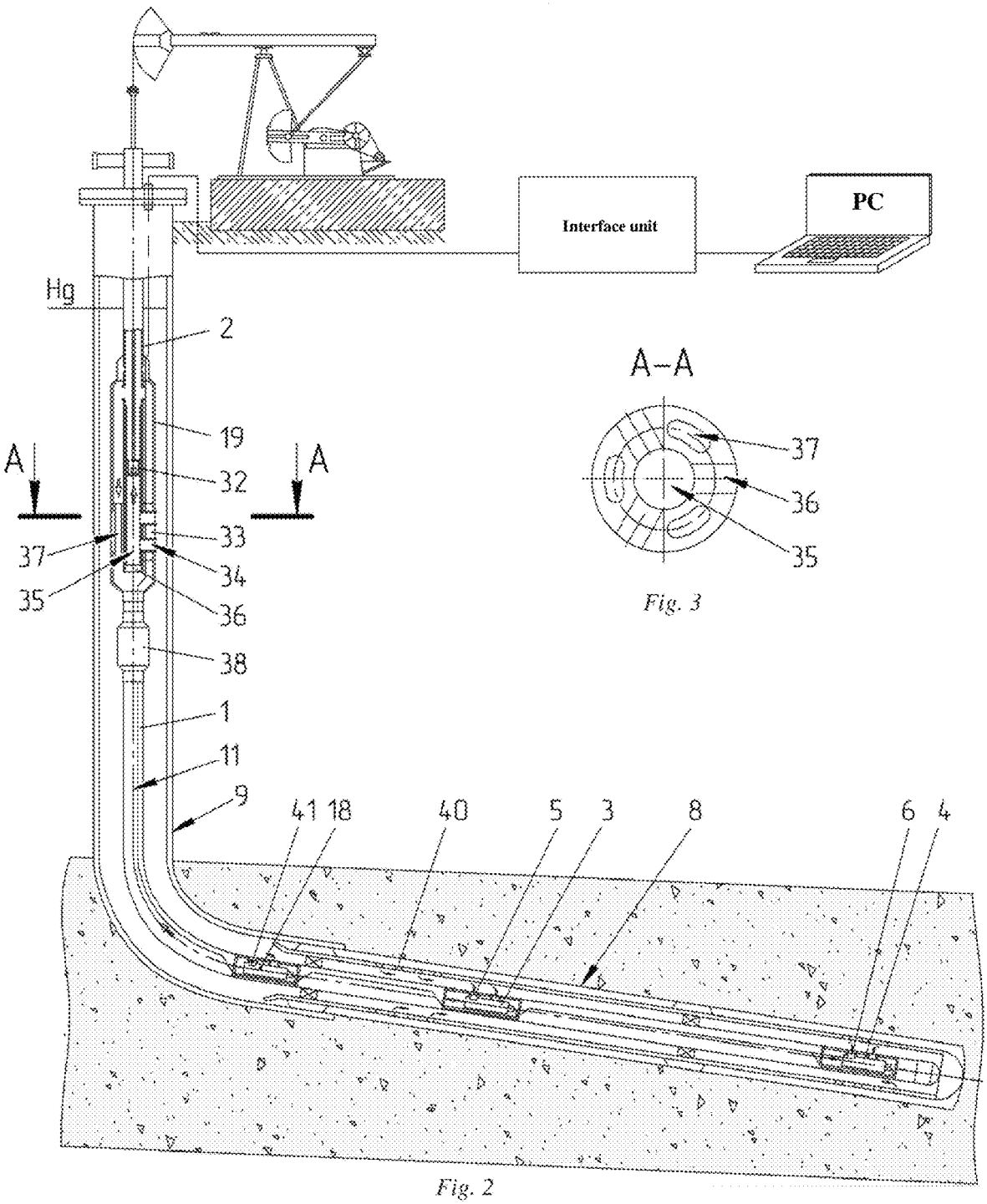
FIG. 2 shows the device with centrifugal pump with the sucker-rod pump.
FIG. 3 shows cross-section A-A of FIG. 2.

If the sucker-rod pump is used (FIG. 2), the production fluid is extracted from the horizontal segment (8) of the well (9) through the opened electric valves (3), (4) and the opened circulation electric valve (18) from whence it comes into the well bore of the well (9) and to the sucker-rod pump (32).

The novelty consists in the fact that the external casing (19) comprises the adapter (33) having radial channels (34) (FIG. 2, 3) connecting the space of the well (9) (FIG. 2) with the central axial channel (35) and the sucker-rod pump (32), wherein the central channel (35) is closed with the blank plug (36) from below. To inject the chemical composition into the horizontal segment (8) of the well (9), the adapter (33) features lateral channels (37) (FIG. 2, 3) that are coaxial with the central channel (35).

Besides, the pipe string (1) is additionally provided with an electric valve (38) for closing the tube side (11) of the pipe string (1) below the casing (19) when extracting the production fluid, and for its opening when injecting the chemical composition into the horizontal segment (8) of the well (9) during the bottomhole formation zone treatment.

The method is effected as follows.

In the formation (12) (FIG. 1), a horizontal segment (8) of the well (9) is bored preliminarily. After conducting the geophysical survey and determining the number and lengths of the oil recovery intervals (low permeability, medium- or high permeability), a tail pipe (or tail filter) (13) of the casing string (14) with packers (15), (7) and drive shoe (39) is lowered down into the horizontal segment (8) and installed there (FIG. 1).

In the process, the packers (15) and (7) are arranged so that they would isolate the recovery intervals with various permeability along the length of the horizontal segment (8) (FIG. 1 shows two intervals), and the tail pipe (13) is perforated with openings (40) (or provided with well strainers) located opposite each of the intervals.

Then an assembly on the pipe string (1) is lowered down into the horizontal segment (8) and installed inside the tail pipe (13), the same assembly consisting of the electric valves (3), (4) with the pressure and temperature sensing devices (5), (6) (FIG. 1), cables (2) and packers (16) (FIG. 1), while arranging the packers (16) so that they would be located opposite to the corresponding packers (7) and (15) hermetically separating the annular space (17). A circulation electric valve (18) is installed into the pipe string (1) above the tail pipe (13) packer (15), and a centrifugal pump (10) in the casing (19) rigidly connected with the pipe string (1) is arranged inside the vertical well bore of the well (9).

In so doing, the electric valves (3), (4) are opened for better filling of the tube side (11) of the pipe string (1) with the well (9) production fluid, and the circulation electric valve (18) is closed.

The production fluid is recovered from the horizontal segment (8) using the centrifugal pump (10) through the tube side (11) of the pipe string (1).

Based on the information transferred from the sensing devices (5), (6) through the cable (2) to the well (9) mouth, the pressure and corresponding temperature values are determined in each of the segments.

When the well (9) is operated with the sucker-rod pump (32) (FIG. 2), the filling of the tube side (11) of the pipe string (1) with the production fluid of the well (9) while lowering down the equipment is performed with the electric valves (3), (4), (18) and (38) opened. Before extracting the production fluid of the well (9) with the help of the sucker-rod pump (32), the electric valve (38) is closed.

The data obtained from the sensing devices (5), (6), (41) are monitored continuously. When necessary, the electric valves (3) and (4) are closed (or opened). For this end, a signal is sent through the cable (2) from the well (9) mouth to the corresponding electric valve (3) or (4). In doing so, the electric motor (21) (FIG. 4) located in the case (20) of the electric valve (3) or (4) starts rotating the shaft (23) with the spindle (24) through the gear box (22), turning the ball (30) with the cylindrical through-hole (31) so as to connect (disconnect) the inlet opening (28) with the outlet opening (29), i.e., to «open» (or «close») the electric valve (3) or (4). The design of the circulation electric valve (18) is similar to the design of the electric valves (3) or (4).

In the process, the production fluid from the corresponding interval of the horizontal segment (8) (FIG. 1) comes through the longitudinal channel (42) (FIG. 4) made in the case (20) of the electric valve (3) or (4) and is drawn up through the tube side (11) (FIG. 1) into the casing (19) and to the inlet of the centrifugal pump (10) with the circulation electric valve (18) closed.

When it is necessary to inject the chemical composition for the formation (12) treatment into the corresponding horizontal segment (8) interval of the well (9), the electric valves (3) and (4) are closed and the circulation electric valve (18) is opened, after which the production fluid is pushed out from the tube side (11) to the surface through the annular space (43) of the casing string (14) by injecting the calculated volume of the chemical composition into the tube side (11) of the string (1) up to the circulation valve (18).

That said, the centrifugal pump, the electric cables, the electric valves and the packers should be made corrosion resistant.

Then the communication with the annular space (43) is shut off in the circulation valve (18), and the corresponding electric valve (3) or (4) is opened for performing the treatment of the necessary formation (12) interval. For this end, the necessary volume of the chemical composition is forced into the formation (12), and the electric valve (3) or (4) is closed for the technological exposure period.

After the technological exposure, the corresponding electric valve (3) or (4) is opened, the centrifugal pump (10) is started, and the production fluid located in the tube side (11) is pumped out. During the pumping out of the production fluid, the reaction products fill the tube side (11) up to the casing (19). The pump is stopped, the electric valve (3) or (4) is closed, the electric valve (18) is opened, and the reaction products are evacuated to the surface through the annular space (43). This operation is repeated until the production fluid appears at the surface.

Then the extraction of the production fluid is continued in normal mode.

The formation (12) interval treatment technology for the wells operated with the help of the sucker-rod pump (32) (FIG. 2) provides for the pushing out of the production fluid from the annular space (43) by injecting the calculated volume of the chemical composition into the tube side (11) of the pipe string (1) through the lateral channels (37) of the adapter (33) and opened electric valve (38). In the process, the circulation electric valve (18) is opened and the electric valves (3) and (4) are closed beforehand.

Then, after the pushing out of the production fluid from the tube side (11), the communication with the annular space (43) in the circulation electric valve (18) is shut off and the corresponding electric valve (3) or (4) is opened for performing the treatment of the corresponding formation (12) interval. For this end, the necessary volume of the chemical composition is forced into the formation (12), and the electric valve (3) or (4) is closed for the technological exposure period.

After the technological exposure, the electric valve (38) is closed, the electric valve (3) or (4) and the circulation valve (18) are opened, the sucker-rod pump (32) is started, and the production fluid located in the annular space (43) is pumped out. During the pumping out of the production fluid, the reaction products fill the annular space (43) up to the lower part of the sucker-rod pump (32). The pump is stopped, the electric valve (3) or (4) is closed and the electric valve (38) is opened. By injecting the production fluid into the tube side of the pipe string (1) (e.g., using the TsA-320 unit) through the circulation valve (18) and the annular space (43), the reaction products are evacuated to the surface. This operation is repeated until the production fluid appears at the surface.

Then the extraction of the production fluid is continued in normal mode.

Thus, the use of the invention allows expanding technological capabilities when extracting products from the wells with horizontal segments cased with the tail pipes through placing the pipe string with the electric valves in the tail pipe, wherein the electric valves, thanks to the packers, are hermetically arranged opposite to the various permeability intervals, with the possibility of shutting off the watered out intervals without stopping the oil extraction; wherein additional independent channels are used for the interval treatment of the formations with the chemical composition (without raising the downhole pumping equipment or the involvement of the well production maintenance' and well workover crews), the same channels excluding the action of the chemical reagents and of the high pressure on the production string walls and allowing changing the downhole pumping equipment without withdrawing the device to the surface; and, additionally, thanks to using the electric valves with the swinging type shutting-off device, their reliability is improved.

EXAMPLE

The formation (12) interval treatment technology for the wells operated with the help of the sucker-rod pump mode (32) (FIG. 2) provides for the pushing out of the production fluid from the annular space (43) by injecting a chemical composition, e.g., 10-16% hydrochloric acid water solution in the amount of 0.6-1 m3 per 1 m of the exposed formation thickness into the tube side (11) of the pipe string (1) through the lateral channels (37) of the adapter (33) and the opened electric valve (38). In the process, the circulation electric valve (18) is opened and the electric valves (3) and (4) are closed beforehand.

Then, after the pushing out of the production fluid from the tube side (11), the communication with the annular space (43) in the circulation electric valve (18) is shut off and the corresponding electric valve (3) or (4) is opened for performing the treatment of the corresponding formation (12) interval. For this end, the necessary volume of the chemical composition is forced into the formation (12), and the electric valve (3) or (4) is closed. The chemical composition exposure time is 2 h. After the technological exposure, the electric valve (38) is closed, the electric valve (3) or (4) and the circulation valve (18) are opened, the sucker-rod pump (32) is started and the production fluid located in the annular space (43) is pumped out. During the pumping out of the production fluid, the reaction products fill the annular space (43) up to the lower part of the sucker-rod pump (32). The pump is stopped, the electric valve (3) or (4) is closed and the electric valve (38) is opened. By injecting the production fluid into the tube side of the pipe string (1) (e.g., using the TsA-320 unit) through the circulation valve (18) and the annular space (43), the reaction products are evacuated to the surface. This operation is repeated until the production fluid appears at the surface.

The invention claimed is:

1. A method of treating intervals in a horizontal well in connection with a preliminarily bored horizontal segment of the well, the segment having been constructed through a formation with various permeability zones, wherein a geophysical survey is conducted and a number of, and sizes for, oil recovery intervals of various categories are determined, the method comprising:

lowering down into the horizontal segment, and installing, a tail pipe or a tail filter of a casing string with first packers and a drive shoe arranged on the casing string in accordance with the sizes of the oil recovery intervals;

lowering down into the horizontal segment, and installing inside the tail pipe, an assembly on a pipe string, the assembly including electric valves with pressure and temperature sensing devices, a cable and second packers, the second packers being arranged opposite to corresponding first packers and hermetically separating an annular space of the horizontal segment, wherein a pump in a casing rigidly connected with the pipe string is arranged inside the casing string;

while lowering the assembly down into the well, opening the electric valves to help fill a tube side of the pipe string with a product of the well, and a circulation valve being closed;

monitoring data obtained from the sensing devices; and injecting a chemical composition into one or more of the intervals of the horizontal segment to periodically treat the formation.

2. The method according to claim 1, wherein:

the product of the well is a production fluid, during the lowering, the tube side of the pipe string is filled with the production fluid and the electric valves and the circulation valve are opened when the well is operated.

3. The method according to claim 1, wherein:

the product of the well is a production fluid, and another electric valve located upstream of the horizontal segment is closed before the production fluid is extracted.

4. The method according to claim 1, wherein the electric valves and are closed or opened to monitor the data obtained from the sensing devices.

5. The method according to claim 1, wherein the product of the well is a production fluid, and the injecting comprises:

(a) closing the electric valves and opening the circulation valve;

(b) pushing the production fluid out from the tube side to the surface through an annular space of the casing string by injecting a calculated volume of the chemical composition into the tube side up to the circulation valve;

(c) shutting off communication with the annular space of the casing string by the circulation valve, and opening a corresponding one of the electric valves for the treatment of the formation;

(d) forcing the calculated volume of the chemical composition into the formation, and closing the corresponding one of the electric valves for an exposure period;

(e) after the period, opening the corresponding one of the electric valves, starting the pump, and pumping the production fluid located in the tube side out from to the casing;

(f) closing the corresponding one of the electric valves, opening the circulation valve, and washing reaction products out from the tube side to the surface;

(g) repeating (a)-(f) until the production fluid appears at the surface, and then continuing to extract the production fluid in a normal mode.

6. A device for treating intervals in a well operated using downhole pumping equipment, the device comprising:

a pipe string with a cable;

two or more electric valves equipped with sensors;

at least one first packer separating an inner space of a horizontal segment of the well into two or more intervals; and a pump arranged at a calculated distance from a mouth of the well;

wherein the electric valves and the sensors are connected through the cable with an interface unit at the mouth of the well;

wherein the pipe string above the electric valves is equipped with a circulation valve configured to connect a tube side of the pipe string with an annular space of the well during flushing of the pipe string; and wherein the pipe string further comprises an additional electric valve for closing the tube side of the pipe string below a protective casing when extracting production fluid, and for opening the tube side when injecting active agent into the horizontal segment during bottomhole formation zone treatment.

7. The device according to claim 6, wherein one or more of the sensors is a pressure sensor.

8. The device according to claim 6, wherein one or more of the sensors is a temperature sensor.

9. The device according to claim 6, further comprising:

a tail pipe or a tail filter hermetically connected with a casing string; and second packers separating an annular space of the casing string into corresponding permeable sections.

10. The device according to claim 6, wherein the protective casing encloses the pump.

11. The device according to claim 6, wherein each of the electric valves and the circulation valve are formed in connection with an electric motor with a gear box arranged in a case, wherein the electric motor is configured to rotate a shaft connected through a spindle with another valve to interact with seats, wherein inlet and outlet openings are arranged above the seats.

12. The device according to claim 11, wherein the another valve is formed in connection with a ball with a cylindrical through-hole provided across the case, such that in an "open" position, an opening of the ball connects the inlet opening with the outlet opening to allow production fluid to get into the tube side of the pipe string, and such that in a "closed" position, entry of the production fluid into the tube side of the pipe string is shut off.

13. The device according to claim 6, wherein the pump, the cable, the electric valves, and the at least one first packers are corrosion resistant.

14. The device according to claim 6, wherein the cable is arranged inside a tubing joint.

15. A device for treating intervals in a well operated using downhole pumping equipment, the device comprising:

a pipe string with a cable;

two or more electric valves equipped with sensors;

at least one first packer separating an inner space of a horizontal segment of the well into two or more intervals;

a pump arranged at a calculated distance from a mouth of the well; and an external protective casing enclosing the pump;

wherein the electric valves and the sensors are connected through the cable with an interface unit at the mouth of the well;

wherein the pipe string above the electric valves is equipped with a circulation valve configured to connect a tube side of the pipe string with an annular space of the well during flushing of the pipe string; and wherein the external protective casing comprises an adapter having radial channels connecting an annulus of the well with a central axial channel of the pump, wherein the central axial channel is closed from below with a blank plug.

16. The device according to claim 15, wherein lateral channels are formed in the adapter coaxially with the central axial channel.

17. The device according to claim 15, wherein the pipe string further comprises an additional electric valve for closing the tube side of the pipe string below the external protective casing when extracting production fluid, and for opening the tube side when injecting active agent into the horizontal segment during bottomhole formation zone treatment.

* * * * *